US007441811B2

(12) United States Patent
Lawrence

(10) Patent No.: US 7,441,811 B2
(45) Date of Patent: Oct. 28, 2008

(54) CASEMENT WINDOW LOCK

(76) Inventor: Barry G. Lawrence, 1515 Johnstontown Rd., Thomasville, NC (US) 27360-7588

( * ) Notice: Subject to any disclaimer, the term of this patent is extended or adjusted under 35 U.S.C. 154(b) by 222 days.

(21) Appl. No.: 11/094,898

(22) Filed: Mar. 31, 2005

(65) Prior Publication Data

US 2005/0218658 A1 Oct. 6, 2005

Related U.S. Application Data

(60) Provisional application No. 60/558,785, filed on Apr. 1, 2004.

(51) Int. Cl.
*E05C 5/00* (2006.01)

(52) U.S. Cl. ..... 292/110; 292/113; 292/111

(58) Field of Classification Search ..... 292/DIG. 7, 292/DIG. 30, DIG. 33, DIG. 20, DIG. 35, 292/DIG. 47, 204, 110, 109–11, 113, 65, 292/71, 57; 74/548
See application file for complete search history.

(56) References Cited

U.S. PATENT DOCUMENTS

| | | | | | |
|---|---|---|---|---|---|
| 917,567 | A | * | 4/1909 | Eddy | 292/336 |
| 1,102,221 | A | * | 6/1914 | Whitford et al. | 105/435 |
| 4,059,298 | A | | 11/1977 | Van Klompenburg | |
| 4,301,622 | A | | 11/1981 | Dunsmoor | |
| 4,429,910 | A | * | 2/1984 | Anderson | 292/199 |
| 4,610,472 | A | | 9/1986 | Billingsley | |
| 4,674,777 | A | | 6/1987 | Guelck | |
| 4,801,164 | A | * | 1/1989 | Mosch | 292/204 |
| 5,219,195 | A | | 6/1993 | Lawrence | |
| 5,452,925 | A | * | 9/1995 | Huang | 292/57 |
| 5,489,131 | A | | 2/1996 | Blom | |
| RE35,463 | E | * | 2/1997 | Vetter et al. | 292/48 |
| 5,603,538 | A | | 2/1997 | Evers | |
| 5,620,214 | A | * | 4/1997 | Kondratuk | 292/217 |
| 6,161,881 | A | | 12/2000 | Babka et al. | |
| 6,349,576 | B2 | * | 2/2002 | Subliskey | 70/90 |
| 6,367,853 | B1 | | 4/2002 | Briggs | |
| 6,425,611 | B1 | | 7/2002 | Minter et al. | |
| 6,767,038 | B1 | * | 7/2004 | Huml | 292/158 |

OTHER PUBLICATIONS

Truth Hardware—Restoration Locks and Lifts—Brochure—2 pages.
Truth Hardware—Maxim MP-Plus Automatic Multi-Point Door Hardware System—Brochure—2 pages.
Truth Hardware—Nexting Covers for Maxim Operators—Brochure—2 pages.
Truth Hardware—The Complete Maxim System Provides Maximum Results. Maxim Systems—Brochure—2 pages.
Truth Hardware—700 Series Double Hung and Slider Locks—Brochure—2 pages.
Truth Hardware—Restoration Locks and Lifts—Flyer—1 page.

* cited by examiner

*Primary Examiner*—Brian E. Glessner
*Assistant Examiner*—Mark Williams
(74) *Attorney, Agent, or Firm*—Birch, Stewart, Kolasch & Birch, LLP

(57) ABSTRACT

The present invention relates to a casement window locking device having improved function, including improved strength, security, and durability. The invention provides a simple, elegant casement window lock having an extended operating range, is economical to manufacture, and uses few parts.

21 Claims, 6 Drawing Sheets

CASEMENT WINDOW LOCK

CROSS-REFERENCE TO RELATED APPLICATIONS

This application claims priority from provisional application Ser. No. 60/558,785, filed Apr. 1, 2004, which is hereby incorporated entirely herein by reference.

FIELD OF THE INVENTION

The present invention relates to a casement window locking device having improved function, including improved strength, security, and durability.

BACKGROUND

Casement windows are hinged on one vertical edge to a window frame and swing either inward or outward. The closure and locking mechanism is typically located on the vertical edge opposite the hinged edge.

Casement windows have utilized various mechanisms to secure closure, primarily for safety, security, and energy efficiency. There are several problems, however, with current designs and manufacture of casement window locks. First, many casement window locks include a complex set of levers, gears, and pins. These locks are difficult and expensive to make, repair, and replace.

Second, many casement window locks have a restricted range of movement that does not permit the window to fully close and seal shut. This is especially so with casement window locks that are slightly out of alignment with the keeper in the adjacent window pane. This misalignment reduces the energy efficiency of the window and presents a possible security flaw.

Third, the complicated nature of many casement window locks and the requirement of numerous moving parts yield a bulky, unsightly device that detracts from the décor of the window.

Thus, there is a need for a simple, elegant casement window lock that is economical to manufacture, has an extended operating range, and uses a minimum of moving parts.

SUMMARY OF THE INVENTION

It is an object of the present invention to provide an improved casement window lock with an extended functional operating range.

It is further an object of the present invention to provide an improved casement window lock that is easily assembled.

It is further an object of the present invention to provide an improved casement window lock that is inexpensive to manufacture.

It is further an object of the present invention to provide an improved casement window lock with few parts.

DETAILED DESCRIPTION OF THE INVENTION

The invention is a locking device particularly useful for a casement window. The invention as described provides an inexpensive locking device having a superior operating range. In addition, because it includes few parts, the locking device is easily assembled.

Although the invention has been explained in relation to its preferred embodiments, it will be understood that various modifications thereof will become apparent to those skilled in the art upon reading the specification. Therefore, it will be understood that the invention disclosed herein covers such modifications as adapting the invention to secure doors or gates, for example. Described hereafter is the general operation of the lock, followed by a detailed description of the internal parts and their interaction.

Figure 1:
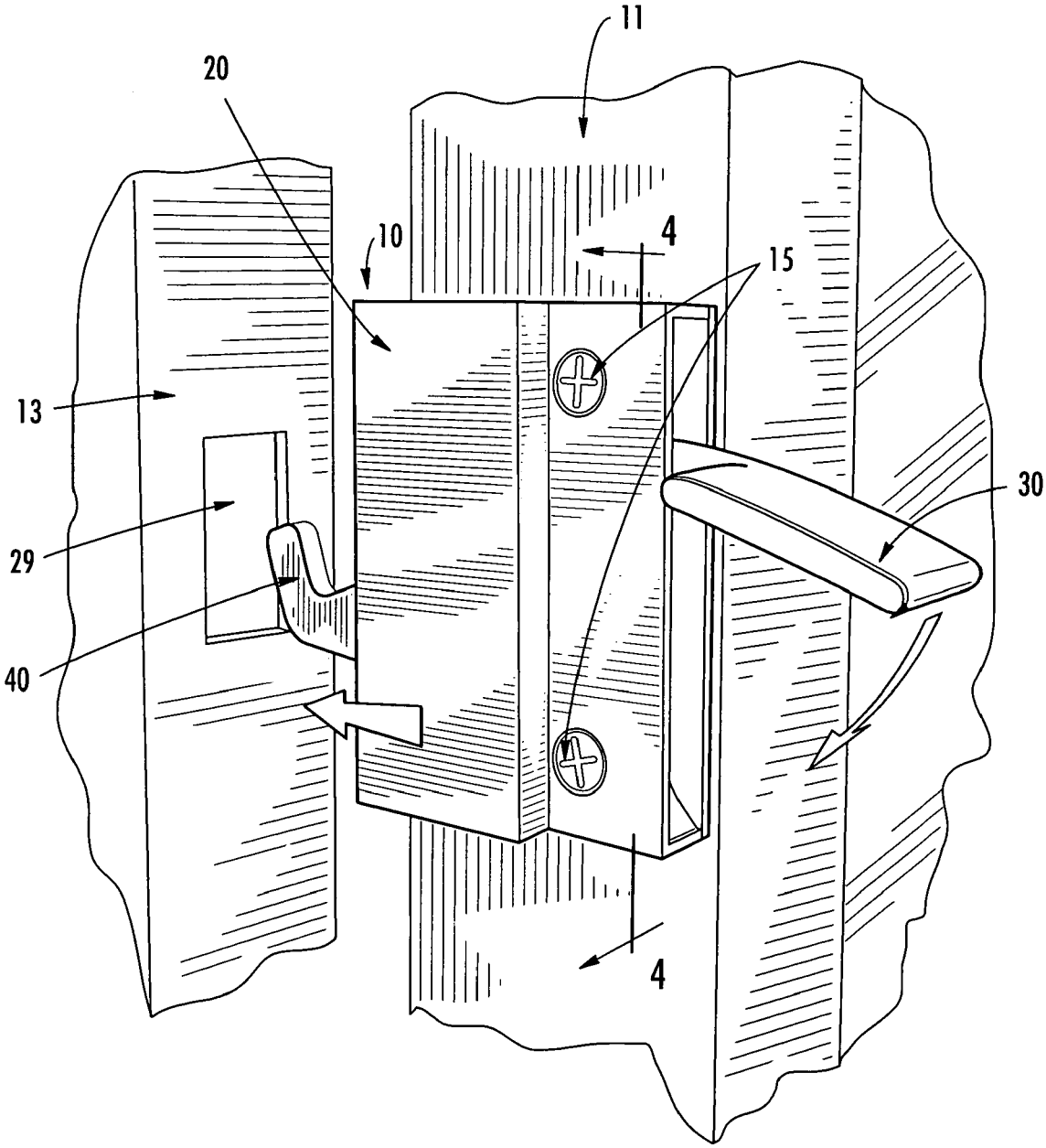
FIG. 1 is a perspective drawing of the fully assembled casement window lock in the open position.
Figure 2:
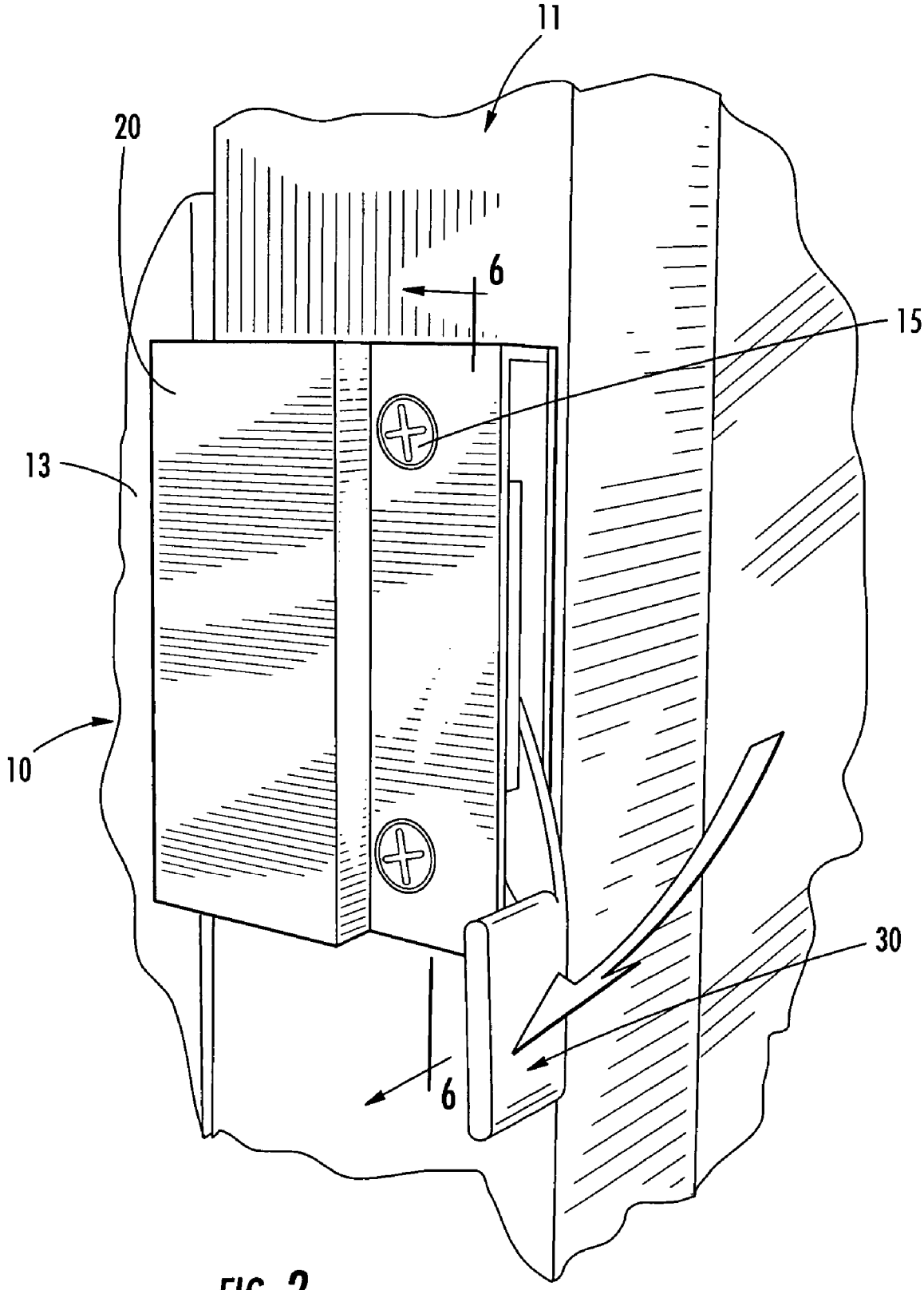
FIG. 2 is a perspective drawing of the fully assembled casement window lock in the closed position.

Referring to the drawings in general and FIGS. 1 and 2 in particular, the assembled casement window lock 10 is illustrated. The lock 10 includes a housing 20 for maintaining the integrity of the assembled lock 10. The housing 20 is further utilized to mount the assembled lock 10 on a vertical edge of a casement window frame 11, preferably adjacent to a keeper 29 in the window sash 13. Mounting is typically accomplished using one or more fasteners, such as one or more threaded screws, which are generally denoted herein by numeral 15. FIGS. 1 and 2 also illustrate other exterior parts of the lock 10 including the handle 30 and the striker 40.

The raised lock handle 30 places the striker 40 in a partially lowered and retracted position. When the handle 30 is lowered, (downward arrow, FIG. 1), the striker 40 extends to engage the keeper 29 (lateral arrow, FIG. 1) mounted in or on the window sash 13. As the handle 30 is further lowered (arrow, FIG. 2), the striker 40 retracts into the housing 20 drawing the window sash 13 against the window frame 11.

In this manner, an operator utilizes the handle 30 to execute a three-stage motion of the striker 40 to engage the keeper 29 and pull the window sash 13 to a secure closed and locked position.

Figure 3:
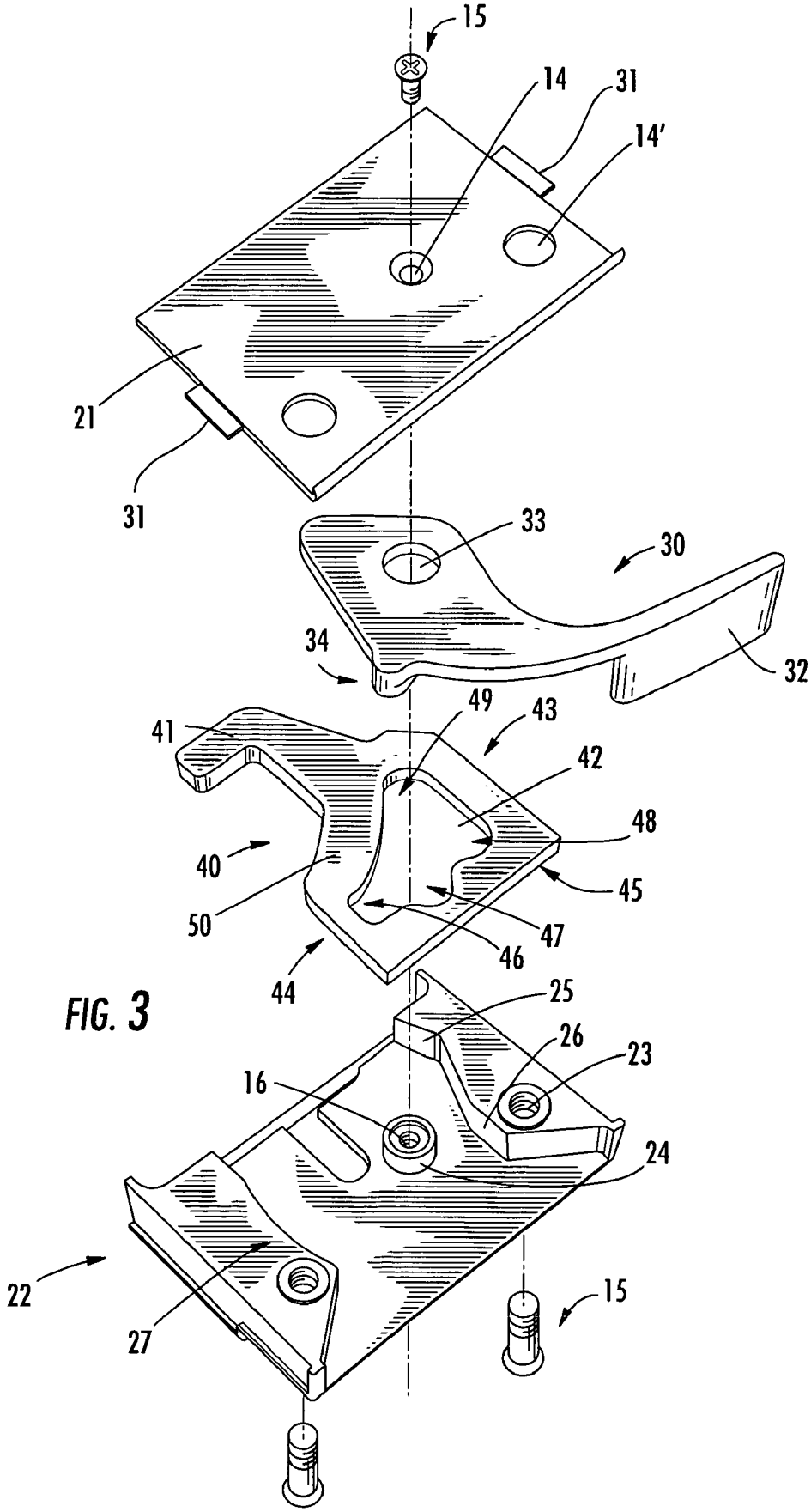
FIG. 3 is an exploded view of the casement window lock showing the face and back of the housing, the handle, and the striker.

FIG. 3 depicts an exploded view of the lock 10. The lock 10 includes four parts. The first two parts are the face plate 21 and base plate 22 of the housing 20. Typically, the face plate 21 and base plate 22 include at least one aperture to accommodate a fastener 15, such as a threaded screw. The purpose of the fastener can be to hold the assembled lock 10 together or to mount the lock 10 to a surface, or both.

FIG. 3 depicts an opening 14 in the face plate 21 to accommodate a fastener 15. This fastener 15 holds the assembled lock together in conjunction with the base plate 22. Specifically, the anchor peg 24 of the base plate 22 surrounds a threaded aperture 16.

In a preferred embodiment, the threaded aperture 16 of the anchor peg 24 aligns with the opening 14 in the face plate 21 such that only one fastener 15 is required to assemble the lock 10.

FIG. 3 further shows a mounting opening 14' in both the face plate 21 and the base plate 22. In a preferred embodiment, a fastener 15 mounts the lock 10 via the mounting opening 14' and the mounting aperture 23 (see also FIGS. 1 and 2).

Alternatively, for aesthetic purposes, the face plate 21 may be constructed without apertures. The face plate 21 can be constructed to "snap" onto the base plate 22 using one or more tabs 31 (e.g., clips or flexible lips). For example, the tabs 31 may be positioned on either the face plate 21 or the base plate 22 and engage a corresponding recess on the other plate (not shown). The fastener is hidden underneath the face plate 21 yet accomplishes the previously discussed functions.

Figure 6:
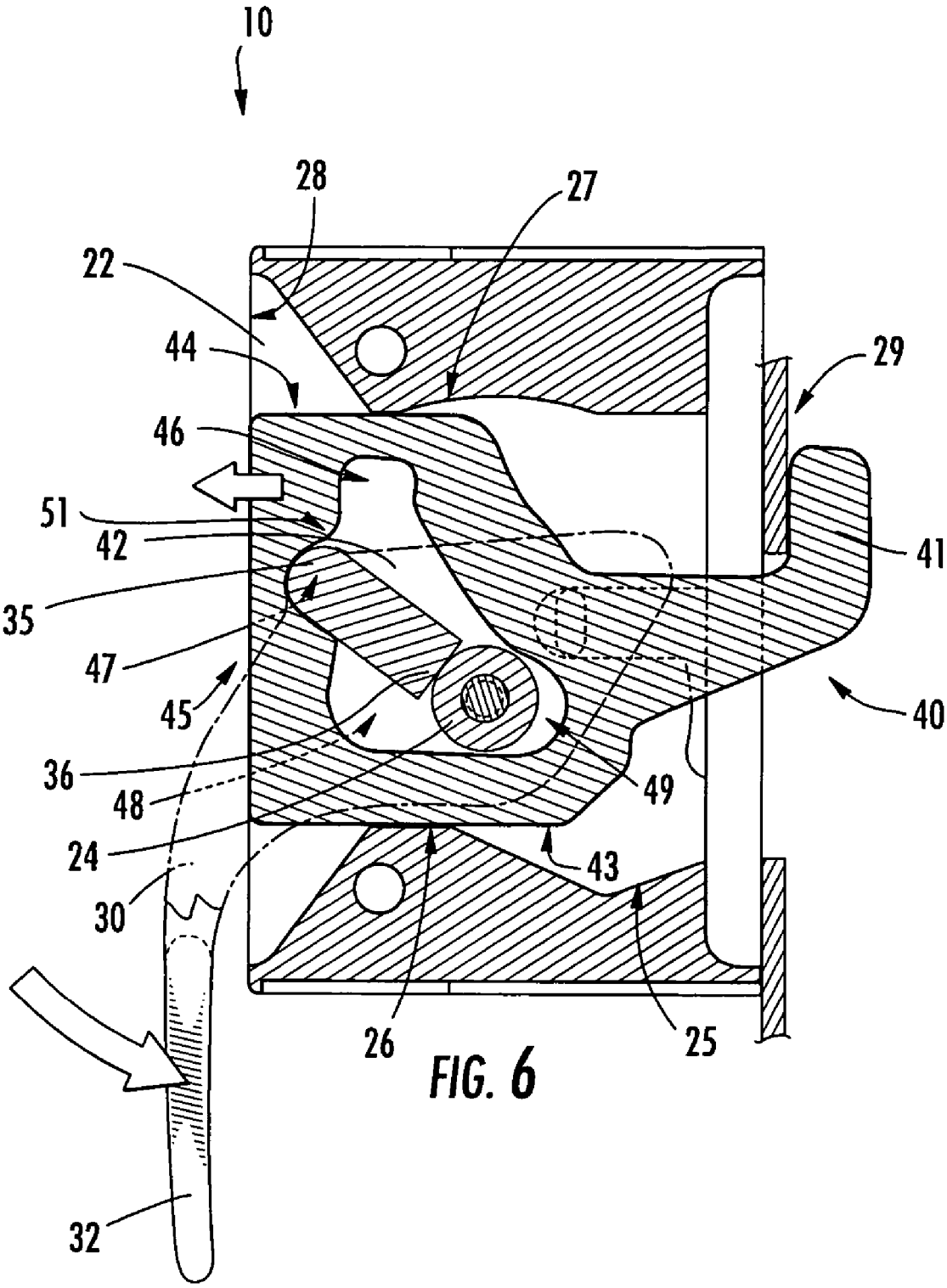
FIG. 6 is a front plan view of the assembled casement window lock in the closed position.

The base plate 22 further includes the previously discussed anchor peg 24, a lower bottom striker interface 25, an upper bottom striker interface 26, a top striker interface 27, and a rear interior surface 28 (see FIG. 6). The anchor peg 24 provides a pivot point for the handle 30 and fixes the striker 40 in either an open (i.e., unlocked) position or a closed (i.e., locked) position.

The lower bottom striker interface 25, upper bottom striker interface 26, and top striker interface 27 guide the striker 40 through its range of motion from an unlocked position to a locked position. The rear interior surface 28 is an abutment for the back edge 45 of the striker 40 (see FIG. 6).

The third part of the lock 10 is a handle 30 having a grip 32 for operation, a handle aperture 33 for through-mounting a fastener 15 and accommodating the anchor peg 24, and a thumb 34. The thumb 34 includes a rounded end 35 for interacting with the striker 40 and a flat end 36 for interacting with the anchor peg 24 (see FIGS. 4-6).

The fourth part is the striker 40. The striker 40 includes a hook portion 41 that engages the keeper 29, and an aft portion 50 on the end opposite the hook portion 41. The aft portion 50 surrounds and defines a variably contoured aperture 42. The variably contoured aperture 42 interacts with the rounded end 35 of the thumb 34 and the anchor peg 24. Specifically, the variably contoured aperture 42 incorporates first and second 46,47 recesses, which interact with the rounded end 35 of the thumb 34, and third and fourth 48,49 recesses, which interact with the anchor peg 24. The striker 40 also has a bottom edge 43, a top edge 44, and a back edge 45.

Figure 4:
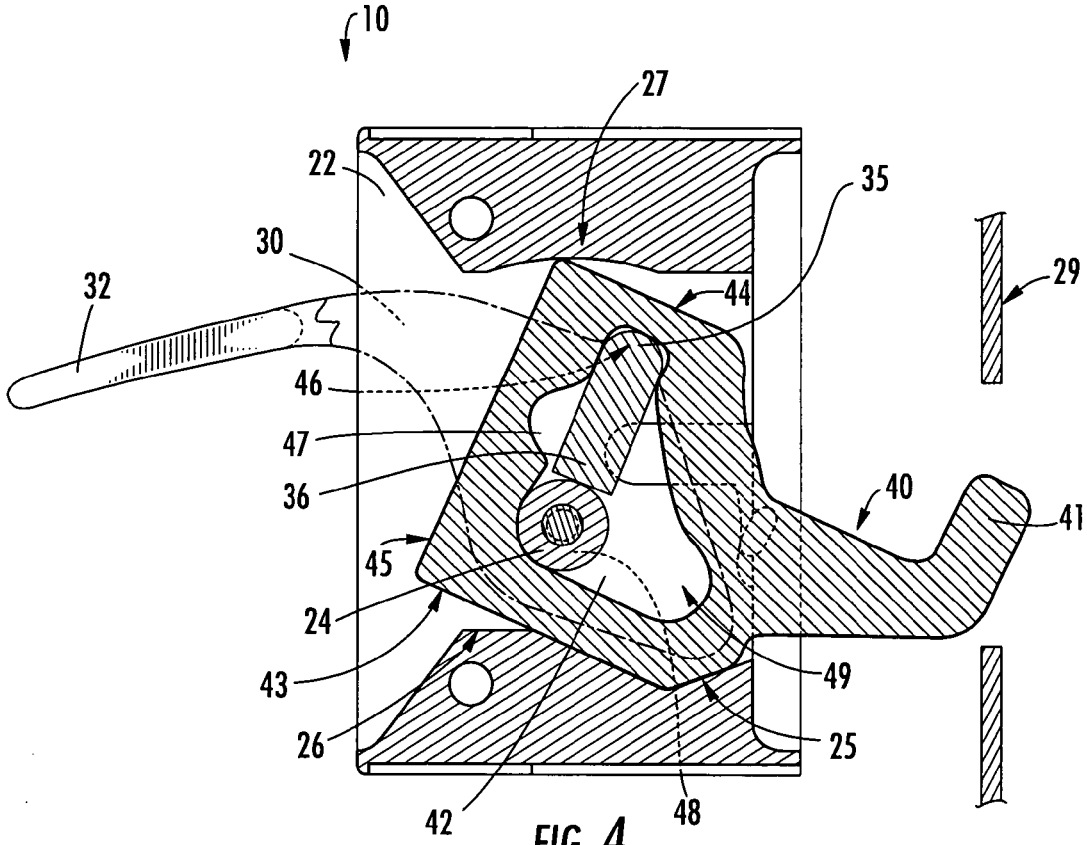
FIG. 4 is a front plan view of the assembled casement window lock in the open position.
Figure 5:
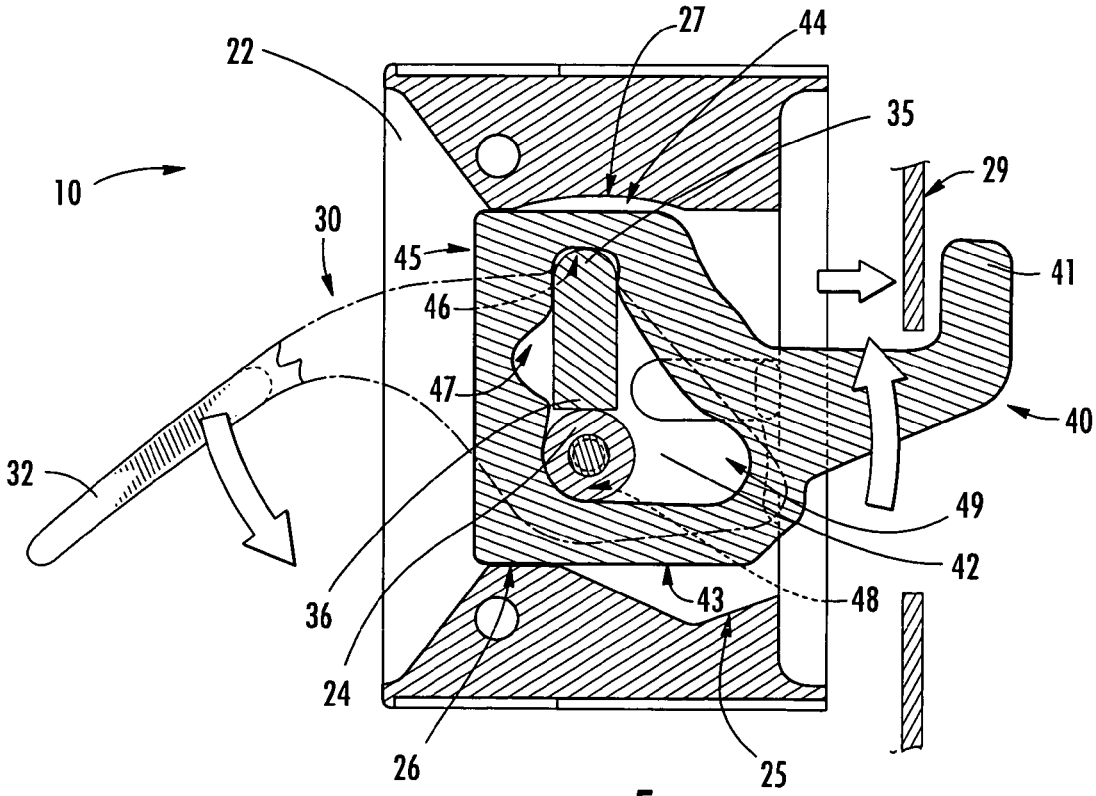
FIG. 5 is a front plan view of the assembled casement window lock in a partially closed position.

FIGS. 4-6 illustrate the lock 10 as the handle 30 passes through its range of motion between the open (FIG. 4), partially engaged (FIG. 5), and closed (FIG. 6) positions.

Shown in FIG. 4, the bottom edge 43 of the striker 40 rests upon the lower bottom striker interface 25 of the base plate 22. While in the open position, the rounded end 35 of the thumb 34 engages the first recess 46 of the variably contoured aperture 42 while the flat end 36 of the thumb 34 contacts the anchor peg 24. Likewise, the anchor peg 24 is seated within the third recess 48 of the variably contoured aperture 42.

Shown in FIG. 5, the partially engaged lock position illustrates that as the handle 30 is lowered (downward arrow), the flat end 36 of the thumb 34 begins to pivot around the anchor peg 24 while the rounded end 35 of the thumb 34 stays within the first recess 46 of the variably contoured aperture 42. This projects the hook portion 41 of the striker 40 outward and upward toward the keeper 29 (see lateral and upward arrows). Next, the striker 40 rises such that its bottom edge 43 rests upon the upper bottom striker interface 26, and the hook portion 41 of the striker 40 rises (upward arrow) to engage the keeper 29. The top edge 44 of the striker 40 contacts the top striker interface 27 of the base plate 22. The anchor peg 24 remains seated within the third recess 48 of the variably contoured aperture 42.

Shown in FIG. 6, the locked position depicts four actions.

First, as the handle 30 is fully lowered (downward arrow), the flat end 36 of the thumb 34 further pivots around the anchor peg 24.

Second, the striker 40 moves in the opposite direction from the keeper 29 (lateral arrow), thereby drawing the hook portion 41 of the striker 40 against the keeper 29. The upper bottom striker interface 26 and the top striker interface 27 of the base plate 22 guide the striker 40 via their respective contact with the bottom edge 43 and the top edge 44 of the striker 40.

Third, as the striker 40 is drawn in the direction of the lateral arrow, the anchor peg 24 seats within the fourth recess 49 of the variably contoured aperture 42, and the back edge 45 of the striker 40 contacts the rear interior surface 28 of the housing 20.

Fourth, the rounded end 35 of the thumb 34 seats within the second recess 47 of the variably contoured aperture 42. A projection 51 between the first and second recesses 46,47 of the striker 40 maintains the lock 10 in the closed position (see FIG. 6).

Figure 7:
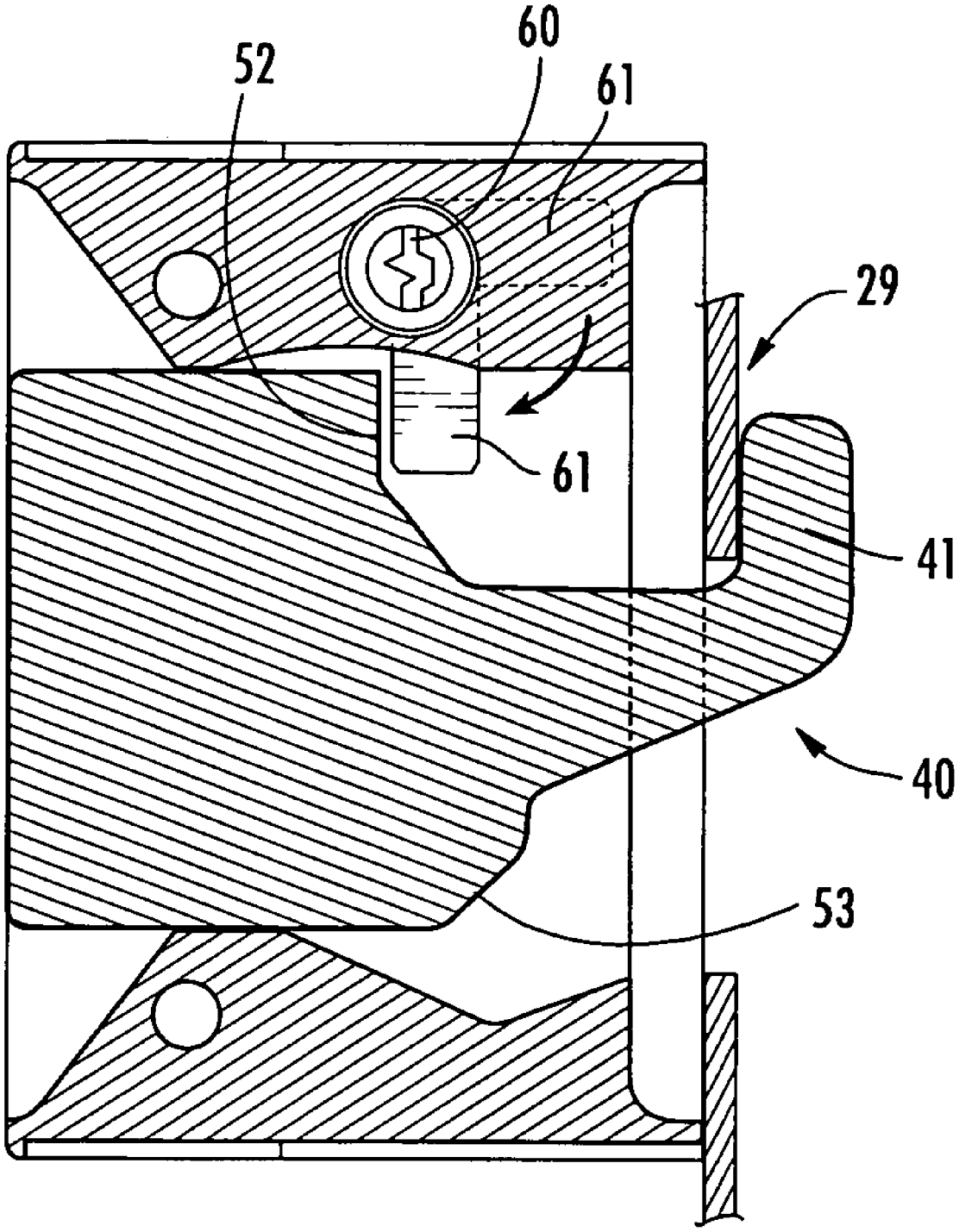
FIG. 7 is a front plan view of the partially assembled casement window lock with a key-actuated locking mechanism.

Alternatively, the lock 10 may include a key-actuated lock mechanism as depicted in FIG. 7. The key-actuated lock 60 serves to secure the lock 10 (specifically the striker 40) in the locked position. For example, the key-actuated lock 60 may move a locking tab 61 from a first unlocked position to a second locked position. In the unlocked position, the locking tab 61 may rest within a recess (not shown) in the base plate 22. In the locked position, the locking tab 61 will be moved to abut a portion of the striker 40 (e.g., an upper edge 52 of the striker 40, arrow, FIG. 7). In this manner, the striker 40 can not disengage the keeper 29 and the lock 10 remains in the locked position.

Other locking means are also suitable. For example, a similar key-actuated locking mechanism may be placed to interact with a lower edge 53 of the striker 40 in a like manner as previously described.

The lock 10 may be formed of a metal material, including, but not limited to, steel, titanium, brass, pewter, aluminum, or tin, or any alloys thereof. Furthermore, the metal material may be plated or coated to enhance its appearance, retard oxidation and corrosion, and to reduce the coefficient of friction between the moving parts. Substances suitable for this purpose include, but are not limited to, zinc, brass, bronze, chrome, or paint.

The lock 10 may also be formed from plastic. Plastic materials include, but are not limited to, fiberglass, fiberglass-reinforced nylon, glass-filled nylon, glass-filled polypropylene, polyester, and vinyl.

The plastic material may also be coated to enhance its appearance. In addition, the lock 10 may be constructed of a combination of metal and plastic parts, or metal parts coated with plastic.

It will be understood that the illustrations are for describing typical embodiments of the invention and are not be construed as limiting. Furthermore, such terms as "up," "down," "front," "back," "forward," "rearward," "top," "bottom," "outward," and the like are used strictly for convenience. Like numbers refer to like elements throughout the drawings and specification.

In the specification and the drawings, typical embodiments of the invention have been disclosed. Specific terms have been used only in a generic and descriptive sense, and not for purposes of limitation. The scope of the invention is set forth in the following claims.

The invention claimed is:

1. A locking device, comprising:

a handle comprising a grip and a raised thumb on opposite ends of said handle, said thumb having a rounded end and a flat end;

a housing comprising a face plate and a base plate, said base plate having a substantially round anchor peg about its center; and a striker comprising a hook portion and an aft portion on opposite ends of said striker, said aft portion defining therein a variably contoured aperture having first, second, third, and fourth recesses, wherein said anchor peg seats within said third recess of said variably contoured aperture in an unlocked position and seats within said fourth recess of said variably contoured aperture in a locked position.

2. A locking device according claim 1, wherein said rounded end of said raised thumb of said handle engages said first recess of said variably contoured aperture in an unlocked position and engages said second recess of said variably contoured aperture in a locked position.

3. A locking device according to claim 1, wherein the raised thumb is formed on a substantially flat side of the handle that faces the base plate, and wherein the rounded end of the thumb projects outwardly from a side edge of the handle, and said flat end is formed between the rounded end and a pivot hole of the handle.

4. A locking device according to claim 1, wherein said anchor peg further comprises a threaded aperture for accepting a fastener whereby said fastener securer said face plate, said handle, said striker, and said base plate as an assembled lock.

5. A locking device according to claim 1, wherein said flat end of said raised thumb pivots around said anchor peg upon movement of said grip.

6. A locking device according to claim 1, further comprising a key-actuated lock for securing said striker in a locked position.

7. A locking device according to claim 6, wherein a locking tab abuts a front face of said striker.

8. A locking device according to claim 6, wherein a locking tab abuts a bottom face of said striker.

9. A locking device according to claim 1, wherein said face plate attaches to said base plate using one or more tabs.

10. A casement window locking assembly, comprising:

a substantially rectangular window frame;

a window mounted within said frame, said window having substantially parallel horizontal and vertical sashes; a keeper mounted about said window sash; and a locking device mounted about said frame and positioned adjacent said keeper, said locking device itself comprising:

a handle comprising a grip and a raised thumb on opposite ends, said thumb having a rounded end and a flat end;

a housing comprising a face plate and a base plate, said base plate having a substantially round anchor peg about its center; and a striker comprising a hook portion and an aft portion on opposite ends, said aft portion defining therein a variably contoured aperture having first, second, third, and fourth recesses, wherein said anchor peg further comprises a threaded aperture for accepting a fastener whereby said fastener secures together said handle, said striker, and said housing.

11. A casement window locking assembly according to claim 10, wherein said rounded end of said raised thumb of said handle engages said first recess of said variably contoured aperture in an unlocked position and engages said second recess of said variably contoured aperture in a locked position.

12. A casement window locking assembly according to claim 10, wherein said anchor peg seats within said third recess of said variably contoured aperture in an unlocked position and seats within said fourth recess of said variably contoured aperture in a locked position.

13. A casement window locking assembly according to claim 10, wherein said anchor peg formed on the base plate projects through a hole in said handle, and a hole in said striker, and includes an upper surface that presses against an inner surface of the face plate.

14. A casement window locking assembly according to claim 10, wherein said flat end of said raised thumb pivots around said anchor peg upon movement of said grip.

15. A casement window locking assembly according to claim 10, wherein said hook portion engages said keeper in a partially closed position and in a fully closed position and disengages said keeper in an open position.

16. A casement window locking assembly according to claim 10, wherein said locking device further comprises a key-actuated lock for securing said striker in a locked position.

17. A casement window locking assembly according to claim 16, wherein a locking tab abuts an upper edge of said striker.

18. A casement window locking assembly according to claim 16, wherein a locking tab abuts a lower edge of said striker.

19. A casement window locking assembly according to claim 10, wherein said face plate and said base plate attach to each other using one or more tabs.

20. A casement window locking assembly according to claim 10, wherein at least said keeper and said striker are constructed of metal.

21. A locking device, comprising:

a handle comprising a grip and a raised thumb on opposite ends of said handle, said thumb having a rounded end and a flat end;

a housing comprising a face plate and a base plate, said base plate having a substantially round anchor peg about its center; and a striker comprising a hook portion and an aft portion on opposite ends of said striker, said aft portion defining therein a variably contoured aperture having first, second, third, and fourth recesses, wherein said anchor peg seats within said third recess of said variably contoured aperture in an unlocked position and seats within said fourth recess of said variably contoured aperture in a locked position.

* * * * *